United States Patent [19]

Evans

[11] 4,039,261

[45] Aug. 2, 1977

[54] DISPOSABLE TOOTHBRUSH

[76] Inventor: James L. Evans, 24400 Border Hill, Novi, Mich. 48050

[21] Appl. No.: 621,640

[22] Filed: Oct. 14, 1975

[51] Int. Cl.[2] ..... A46B 11/02

[52] U.S. Cl. ..... 401/132; 401/28; 401/268

[58] Field of Search ..... 401/132, 133, 28, 270, 401/286, 26; 125/67, 62 R, 62 A; 15/110

[56] References Cited

U.S. PATENT DOCUMENTS

| | | | |
|---|---|---|---|
| 1,327,757 | 1/1920 | Eggers | 401/28 |
| 2,081,792 | 5/1937 | Cassanos et al. | 401/28 |
| 2,750,614 | 6/1956 | Collins et al. | 401/132 |
| 3,553,759 | 1/1971 | Kramer et al. | 15/110 |

FOREIGN PATENT DOCUMENTS

| | | | |
|---|---|---|---|
| 512,130 | 7/1956 | Italy | 401/132 |
| 614,180 | 12/1948 | United Kingdom | 401/28 |

*Primary Examiner*—Lawrence Charles
*Attorney, Agent, or Firm*—Andrew R. Basile

[57] ABSTRACT

A disposable toothbrush molded from a flexible plastic material and having a brush head carried at one end of a handle. The brush head has a paste-holding cavity and a plurality of hollow bristles molded in and extending from one side of the brush head such that the interiors of the hollow bristles communicate with the paste-holding cavity. A sealing film which functions to maintain the paste within the cavity is punctured upon manual compression of the brush head, such that paste may be squeezed through the hollow bristles to the top end thereof for use. In the second embodiment of the invention the bristle head is disclosed as being separable from the handle.

1 Claim, 7 Drawing Figures

DISPOSABLE TOOTHBRUSH

BACKGROUND OF THE INVENTION

I. Field of the Invention

The present invention relates in general to toothbrushes and, in particular, to a disposable toothbrush molded from a plastic material wherein a convenient toothpaste supply is stored in an appropriate portion of the toothbrush and is usable in such a fashion as to permit the same to be carried by a person during the day for use at any convenient time.

II. Description of the Prior Art

It should be appreciated that heretofore the dispenser type of toothbrushes, which have been proposed, have been relatively cumbersome combinations of parts to provide for the movement of toothpaste from a dispenser to the bristle area of the toothbrush. In such instances various proposed types of dispensers are designed to carry large amounts of paste such that the toothbrush may be used while providing for the convenience of carrying the toothpaste. Such prior art devices have certain disadvantages which include clogging of the passageway between the stored toothpaste and the bristles which may result in the paste becoming stale and hard to use over a given period of time. Examples of the prior art apparatuses and devices which have attempted to overcome the aforementioned difficulties are disclosed in U.S. Pat. Nos. 1,947,721; 2,550,190; 3,075,681; 3,148,684; 3,353,898; 3,432,345; and 3,536,410.

SUMMARY OF THE INVENTION

The present invention, which will be described subsequently in greater detail, comprises a disposable toothbrush and paste dispensing device including a flexible plastic brush head carried at one end of a handle with the brush head having a paste-holding cavity and a plurality of hollow bristles molded in and extending from one side of the brush head for communicating the paste within the cavity to the top of the bristles when a manual compressive pressure is applied to the brush head.

It is therefore an object of the present invention to provide a disposable toothbrush provided with a toothpaste dispenser.

It is also an object of the present invention to provide a disposable toothbrush of the type described which is loaded with a charge of toothpaste sufficient for a single tooth brushing operation such that the toothbrush may be disposed of after initial use.

It is still a further object of the present invention to provide a disposable toothbrush which is simple in design and construction and, thus, of low cost to manufacture.

Other objects, advantages, and applications of the present invention will become apparent to those skilled in the art of disposable toothbrushes when the accompanying description of several examples of the best modes contemplated for practicing the invention is read in conjunction with the accompanying drawing.

BRIEF DESCRIPTION OF THE DRAWING

The description herein makes reference to the accompanying drawing wherein like reference numerals refer to like parts throughout the several views, and wherein.

DESCRIPTION OF THE PREFERRED EMBODIMENTS

Figure 1:
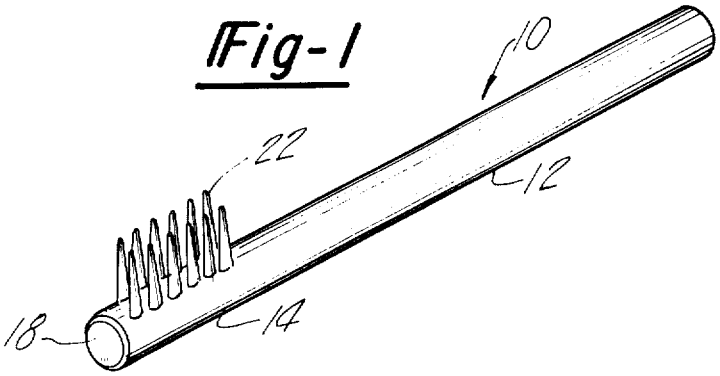
FIG. 1 is a perspective view of a disposable toothbrush constructed in accordance with the principles of the present invention.
Figure 4:
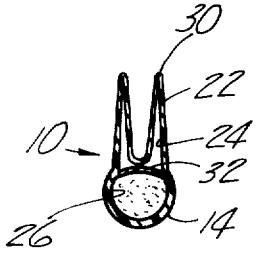
FIG. 4 is a cross-sectional view of the disposable toothbrush taken along Line 4—4 of FIG. 2.
Figure 2:
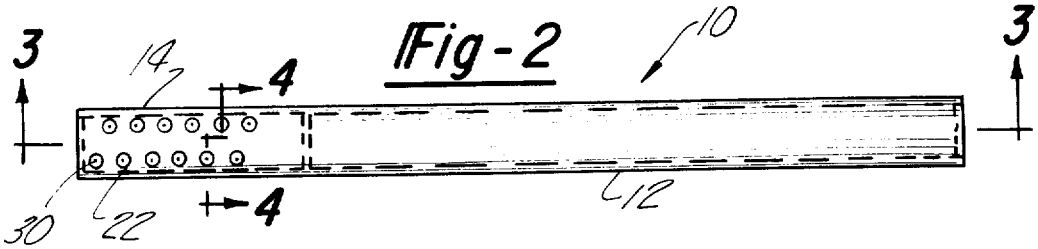
FIG. 2 is a top plan view of the disposable toothbrush illustrated in FIG. 1.
Figure 3:
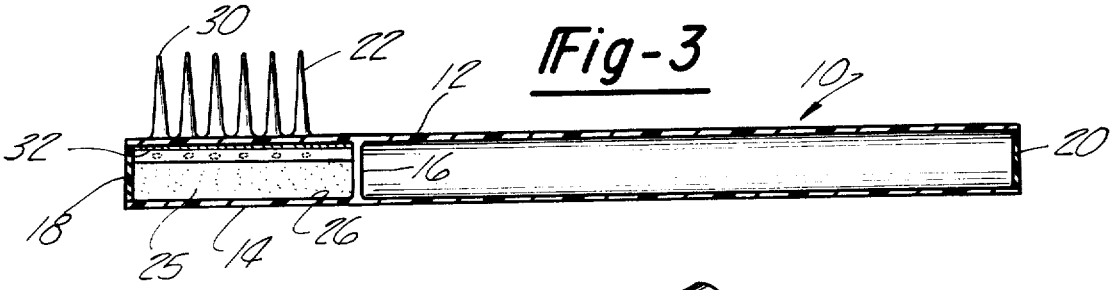
FIG. 3 is a longitudinal sectional view taken along Line 3—3 of FIG. 2.

Referring now to the drawing and, in particular, to FIGS. 1–4 wherein there is illustrated one example of the present invention in the form of a disposable toothbrush 10 which comprises a handle portion 12 integrally connected to a brush head 14. As can best be seen in FIG. 3, the toothbrush 10 is cylindrical in shape with a partition 16 supportably separating the handle portion 12 from the brush head 14 with the opposite ends of the toothbrush 10 being enclosed by caps 18 and 20. The brush head 14 comprises a plurality of bristles 22 which are integrally molded to one side of the brush head 14. The bristles 22 are hollow in that they have longitudinal apertures 24 (FIG. 4) which are in communication with the interior cavity 26 defined by the cylindrical portion forming the brush head 14. The apertures 24 are sized and shaped to permit the passage of toothpaste 25 from within the cavity 26 to the openings 30 at the top of each bristle 22. The cavity 26 of the brush head 14 stores a predetermined quantity of toothpaste 25 and is normally separated from the apertures 24 by a membrane or sealing film 32 which is punctured to permit the passage of the stored toothpaste 25 into the apertures 24 when a manual compressive pressure is applied to the side walls of the brush head 14, squeezing the same. This action forces the toothpaste into the apertures 24 such that a sufficient supply of toothpaste 25 is emitted through the tops 30 of each bristle 22 to provide the user with enough toothpaste 25 for one brushing. After use in the conventional manner the brush 10 may be discarded.

Figure 5:
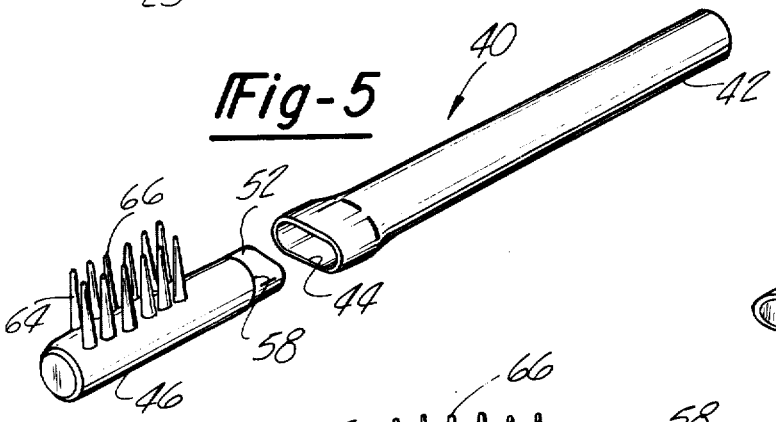
FIG. 5 is an exploded perspective view of a second embodiment of the present invention in the form of a disposable toothbrush having a reusable handle.
Figure 6:
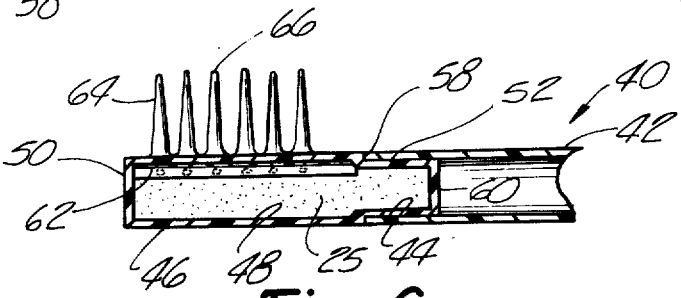
FIG. 6 is a fragmentary longitudinal sectional view of the disposable toothbrush illustrated in FIG. 5.

Referring now to FIGS. 5 and 6 wherein there is illustrated an alternate embodiment of the present invention in the form of a disposable toothbrush 40 which comprises a cylindrically shaped handle portion 42 that has an end oval-shaped aperture 44 that receives and supports a brush head 46. The brush head 46 is substantially identical in construction to the aforementioned brush head 14 in that it is cylindrically shaped defining a toothpaste-holding cavity 48 enclosed by side wall 50 at one end, while its other end is reduced in size to form an oval-shaped sleeve 52 and a shoulder 58. It can be seen that the outer diameter of the oval sleeve 52 is sized to be slidably received in a tight-fit manner into the aperture 44 of the handle 42, with the end of the handle 42 abutting the shoulder 58. The non-circular shape of the oval sleeve 52 and the aperture 44 prevents rotation between the connected parts. A partition 60 at the sleeve end of the brush head 46 is removable to permit the insertion of a toothpaste within the cavity 46 during the manufacturing process of the toothbrush 40 and is sealed at the factory. Similar to the toothbrush 10, the brushing head 46 is provided with a suitable sealing film or membrane 62 which, upon squeezing the flexible cylindrical body of the head 46, will puncture to permit toothpaste 25 to be squeezed from the cavity 48 through longitudinal apertures in bristles 64, such that toothpaste 25 will be emitted at the upper ends 66 of each bristle 64 to permit the user to brush his teeth in a conventional manner.

Figure 7:
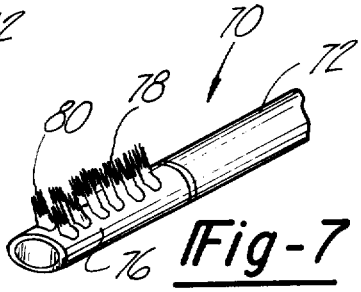
FIG. 7 is a fragmentary perspective view of a third embodiment of the present invention.

Referring now to FIG. 7 wherein there is illustrated a third example of the present invention in the form of a disposable toothbrush 70 which comprises a cylindrically-shaped handle portion 72 that has an end oval-shaped aperture that receives and supports a brush head 76. The brush head 76 is substantially identical in construction to the brush head 46 in that it is cylindrically shaped defining a toothpaste-holding cavity enclosed by side walls at one end, while its other end is reduced in size to form an oval-shaped sleeve that is received within the oval-shaped cavity to prevent relative rotation between the handle 72 and the head 76. The interior of the head 76 stores a sufficient amount of toothpaste to permit a single brushing and is so constructed that, when the brushing head is squeezed, the toothpaste within the head cavity will be squeezed therefrom through the longitudinal portion of bristles 78. It should be noted that the bristles 78 are provided with a plurality of longitudinal slits 80 which, in effect, provide a plurality of passageways through which the toothpaste may be emitted, as well as forming a plurality of bristles for brushing the teeth.

One marked advantage of the present invention over the prior art devices is the emitting of the toothpaste at the top of each bristle for contact with the teeth which results in greater usage of the emitted toothpaste, as opposed to the prior art designs which normally emitted the toothpaste at the bottom of the bristles resulting in an incomplete use of the toothpaste.

The toothbrush handle portion 12 and brush head 14 may be molded from a low-cost plastic material, such as a polystyrene. Additionally, the hollow or apertured bristles would also be formed of this comparable material.

The handle portion and brush head of the disposable toothbrushes 10 and 40 should be so fabricated that the side walls of the brush head 14 are flexible enough to permit the walls to be collapsed inwardly upon the application of a compressive pressure to squeeze the toothpaste through the bristle apertures in the aforementioned manner. This may be accomplished by the use of appropriate materials or by providing a thinner wall section at the brush head section of the disposable toothbrush.

It can thus be seen that the present invention has provided a disposable toothbrush which has a sufficient amount of toothpaste to permit the user to accomplish a single brushing. After the brushing of the indiviual's teeth, the brush may be disposed of. Due to the simplicity of design and construction, the toothbrush is extremely inexpensive to manufacture and, thus, may be disposed of after a single use. In the alternate embodiment of FIGS. 5 and 6 the handle 42 may be retained while several brush heads 14 may be purchased and used with the one handle, such as when the user may be traveling for a several-day period and require the conveniences and advantages of several disposable toothbrushes of the type described.

It should be apparent to those skilled in the art of disposable toothbrushes that other forms of the present invention may be had, all coming within the spirit of the invention and the scope of the appended claims.

What is claimed is as follows:

1. A toothbrush and paste dispensing device comprising:

a handle having an oval shaped cross section and an opening at one end;

a plastic brush head having an oval shaped cross section with one end sized to be slidably received in a tight fit in said handle opening, the outer walls of said brush head defining a sealed paste-holding cavity, said brush head having an outer wall with a plurality of aligned apertures;

a plurality of integrally formed, conically shaped hollow bristles molded in and extending from said outer wall of said brush head and communicating with said paste-holding cavity via said apertures, each of said hollow bristles having a plurality of longitudinal slits for providing an enlarged central opening and a plurality of side wall openings in each bristle to provide a plurality of passageways through which toothpaste may be emitted and to provide an increased number of cleaning edges;

a predetermined quantity of toothpaste in said cavity; and a single sealing film in said cavity covering, all of said apertures and between said toothpaste and the interior of said bristles, the side walls of said brush head being fabricated from a flexible plastic material such that, upon manual squeezing pressure applied to said brush head side walls, the paste therewithin will exert a pressure against said sealing film to puncture the same, squeezing said paste through said hollow bristle passageways to the top ends and side walls of said bristles for application by the user.

* * * * *